US006779681B2

(12) United States Patent
Doerfler et al.

(10) Patent No.: US 6,779,681 B2
(45) Date of Patent: Aug. 24, 2004

(54) LATCH FOR A STORAGE UNIT

(75) Inventors: Matthew Joseph Doerfler, Wooster, OH (US); William Wray Shepler, Brunswick, OH (US); Matthew Garrett Lerch, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 143 days.

(21) Appl. No.: 09/793,027

(22) Filed: Feb. 26, 2001

(65) Prior Publication Data

US 2002/0117507 A1 Aug. 29, 2002

(51) Int. Cl.[7] ..... B65D 43/16; B65D 43/22

(52) U.S. Cl. ..... 220/835; 220/326; 206/1.5; 292/91; 292/209

(58) Field of Search ..... 220/324, 326, 220/835, 4.22, 4.23; 206/1.5; 292/13, 19, 87, 89, 91, 101–103, 107, 120, 238, 209, 203–204, DIG. 11, DIG. 30, 207; 190/119, 120; 70/70, 71

(56) References Cited

U.S. PATENT DOCUMENTS

| | | | | | |
|---|---|---|---|---|---|
| 1,485,050 | A | * | 2/1924 | Phillips | 220/326 |
| 1,890,912 | A | * | 12/1932 | Momm | 292/103 |
| 3,100,980 | A | * | 8/1963 | Humphries | 292/128 |
| 3,266,275 | A | * | 8/1966 | Atkinson | 292/204 |
| 3,394,838 | A | | 7/1968 | Larkin | |
| 3,461,697 | A | * | 8/1969 | Gehrie | 70/71 |
| 3,616,666 | A | * | 11/1971 | Atkinson | 70/70 |
| 3,797,870 | A | * | 3/1974 | Beckman | 292/108 |
| 4,344,646 | A | * | 8/1982 | Michel | 220/326 |
| 4,363,403 | A | * | 12/1982 | Raucci et al. | 206/1.5 |
| 4,502,715 | A | * | 3/1985 | Lundblade | 292/100 |
| D302,774 | S | | 8/1989 | Murphy | |
| 4,901,882 | A | * | 2/1990 | Goncalves | 220/324 |
| 4,964,661 | A | * | 10/1990 | Cadwell et al. | 292/87 |
| 5,040,834 | A | | 8/1991 | Kahl et al. | |
| 5,044,513 | A | | 9/1991 | Van Berne | |
| 5,125,697 | A | | 6/1992 | Kahl et al. | |
| D330,329 | S | | 10/1992 | Brightbill | |
| D339,471 | S | | 9/1993 | Maple et al. | |
| D342,609 | S | | 12/1993 | Brightbill | |
| 5,310,049 | A | * | 5/1994 | Bigelow et al. | 206/1.5 |
| 5,337,913 | A | * | 8/1994 | Fukuda | 220/326 |
| 5,507,385 | A | | 4/1996 | Koloski et al. | |
| D373,021 | S | | 8/1996 | Breen et al. | |
| D378,025 | S | | 2/1997 | Perelli | |
| D379,122 | S | | 5/1997 | Wolff | |
| D381,512 | S | | 7/1997 | Green | |
| D388,957 | S | | 1/1998 | Wolff | |
| 5,706,968 | A | * | 1/1998 | Riley | 220/326 |
| 5,718,350 | A | | 2/1998 | Williams | |
| D391,762 | S | | 3/1998 | Ahern, Jr. | |
| D394,554 | S | | 5/1998 | Mann et al. | |
| 5,762,228 | A | * | 6/1998 | Morgan et al. | 220/367.1 |
| 5,873,476 | A | * | 2/1999 | Takahashi et al. | 220/263 |
| 5,904,269 | A | | 5/1999 | Wolff | |
| D421,678 | S | | 3/2000 | Levy | |
| 6,105,767 | A | * | 8/2000 | Vasudeva | 206/372 |

FOREIGN PATENT DOCUMENTS

| | | | | |
|---|---|---|---|---|
| EP | 526742 | * | 2/1993 | 190/119 |
| GB | 2 332 702 A | | 6/1999 | |

* cited by examiner

*Primary Examiner*—Nathan J. Newhouse
(74) *Attorney, Agent, or Firm*—Marshall, Gerstein & Borun LLP

(57) ABSTRACT

A storage unit is disclosed. The storage unit includes a base having a rim, a cover movable between a closed position and an open position, and a latch configured to releasably couple the cover to the base. The latch includes a user interface configured to pivot between a first position and a second position, a post configured to be at least partially disposed in an aperture in the rim when the user interface is in the second position, and an attachment member that extends from the user interface and is configured to provide a fulcrum about which the user interface pivots.

28 Claims, 10 Drawing Sheets

LATCH FOR A STORAGE UNIT

FIELD OF THE INVENTION

The present invention relates to a latch for a storage unit.

BACKGROUND

It is generally known to provide for a storage unit having a base, a cover, and a latch for securing the cover in a "closed" or "locked" position. Such latches are typically "buckles" or hasps.

However, such known latches has several disadvantages including: requiring two hands to operate; requiring multiple materials and components; having one or more "pinch points" that may pinch the hand of a user; requiring an undesirable amount of force to operate (which makes actuation difficult for some users); requiring precise alignment and/or a secondary device (e.g., lock) to "lock."

To provide an inexpensive, reliable and widely adaptable technique of engaging/locking and disengaging/unlocking such items as storage units and totes to avoid the above-referenced and other problems would represent a significant advance in the art. Accordingly, it would be advantageous to provide a latch for a storage unit. It would also be advantageous to provide an inexpensive, easy-to-manufacture and aesthetically pleasing latch which overcomes the above-noted disadvantages of prior latches for storage units. It would further be advantageous to provide a latch that only requires one hand (or finger) to operate. It would further be advantageous to provide a latch that requires a lesser amount of force to operate. It would further be advantageous to provide a latch that employs components that may be fabricated (e.g., integrally molded) with latch, cover, or base. It would be desirable to provide for a latch having one or more of these or other advantageous features.

SUMMARY OF THE INVENTION

How these and other advantages and features of the present invention are accomplished, individually or in various subcombinations, is described in the following detailed description of the preferred embodiment of the invention, taken in conjunction with the drawings. Generally, however, they may be accomplished in a storage unit comprising a base, a cover movable between a closed position and an open position, and a mechanism configured to releasably couple the cover to the base. The mechanism includes a member that is configured to move between a first position and a second position. In the second position, the member is at least partially disposed in an aperture.

These and other features of the present invention may also be accomplished in a storage unit comprising a base having a rim, a cover movable between a closed position and an open position, and a mechanism configured to releasably couple the cover to the base. The mechanism includes a user interface and a post. The user interface is configured to pivot between a first position and a second position. The post is at least partially disposed in an aperture in the rim when user interface is in the second position.

These and other features of the present invention may further be accomplished in a storage unit comprising a base having a rim, a cover movable between a closed position and an open position, a latch configured to releasably couple the cover to the base. The latch includes a user interface configured to pivot between a first position and a second position, a post configured to be at least partially disposed in an aperture in the rim when the user interface is in the second position, and an attachment member that extends from the user interface and is configured to provide a fulcrum about which the user interface pivots.

The present invention further relates to various features and combinations of features shown and described in the disclosed embodiments. Other ways in which the objects of the present invention are accomplished will be described in the following specification or will become apparent to those skilled in the art after they have read this specification. Such other ways are deemed to fall within the scope of the present invention if they fall within the scope of the claims which follow.

DETAILED DESCRIPTION OF THE PREFERRED EMBODIMENTS

Figure 1:
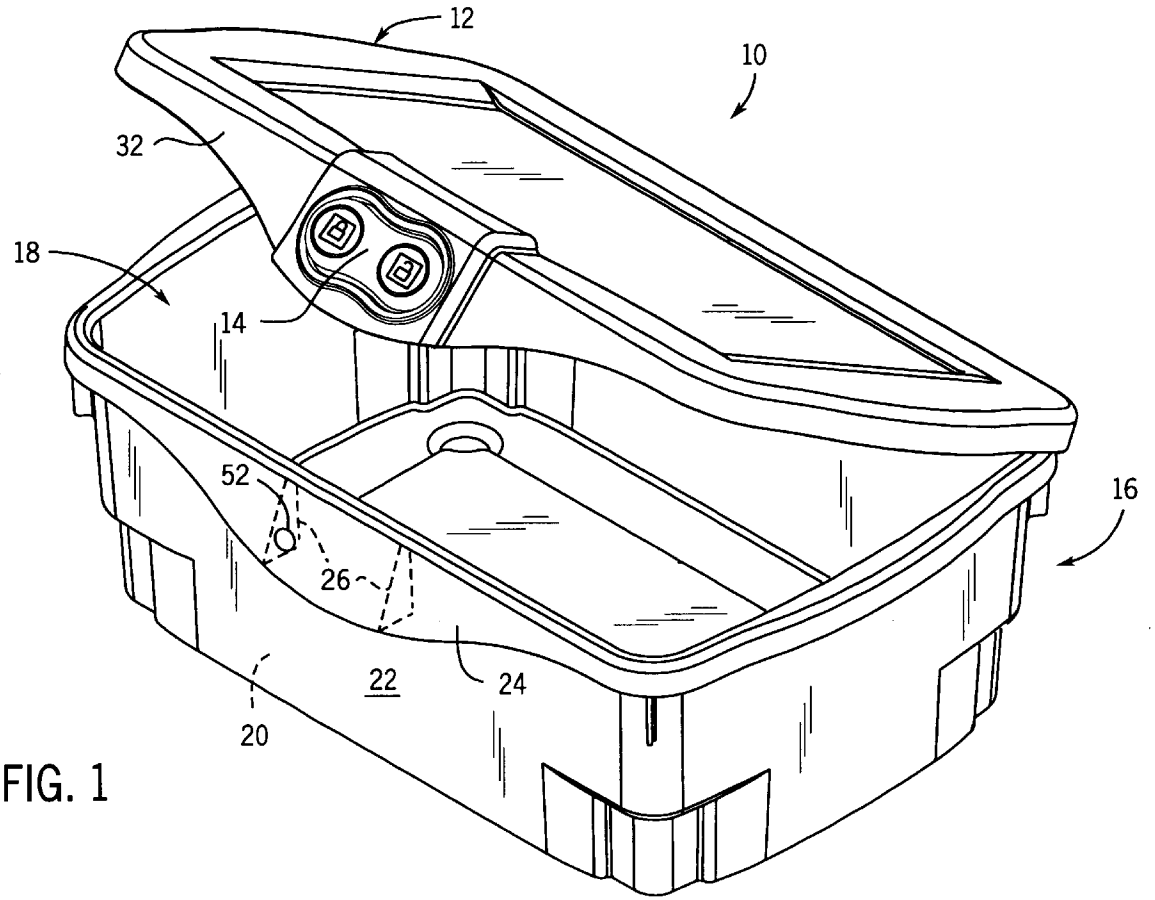
FIG. 1 is a perspective view of the storage unit with the cover partially open according to a preferred embodiment.
Figure 2:
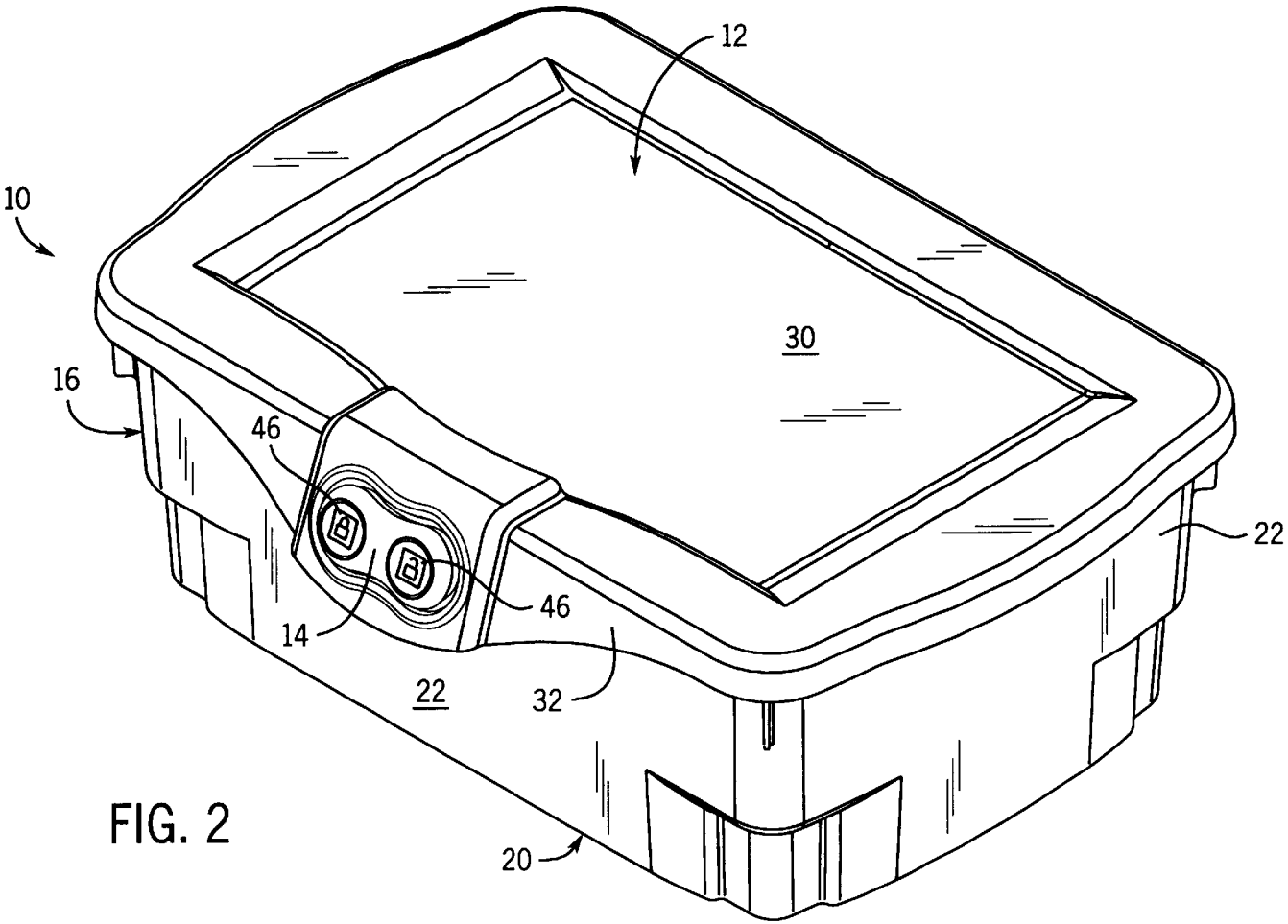
FIG. 2 is a perspective view of the storage unit of FIG. 1 with the cover closed.
Figure 8:
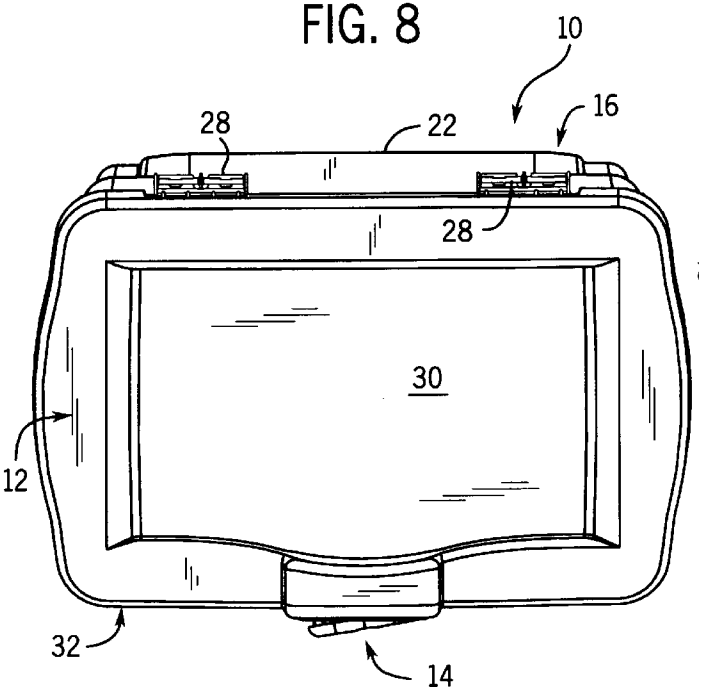
FIG. 8 is a top plan view of the storage unit of FIG. 1 with the latch in an unlocked position.
Figure 7:
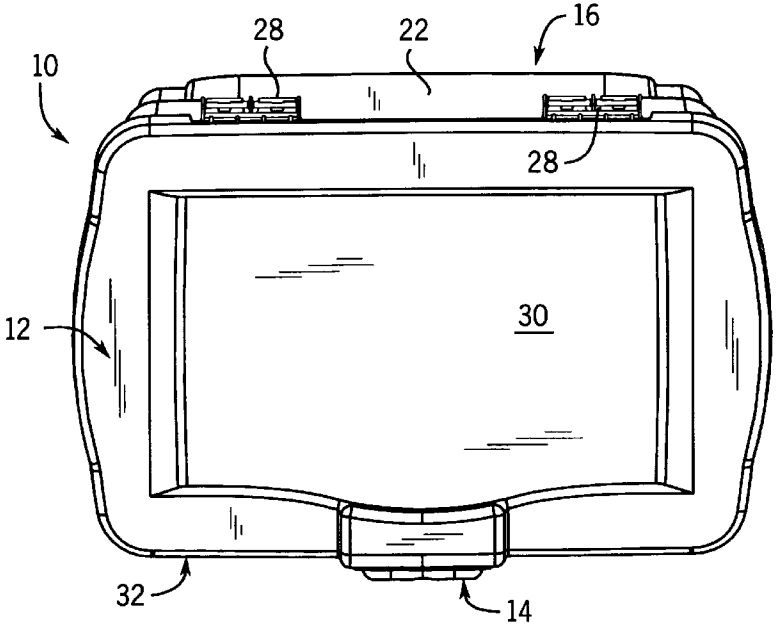
FIG. 7 is a top plan view of the storage unit of FIG. 1 with the latch in a locked position.

Referring to FIGS. 1 and 2, a storage unit 10 having a cover 12 and a mechanism (shown as a latch 14) is shown according to a preferred embodiment. Latch 14 is intended to provide quick and easy access to the interior space of the storage unit 10 with the use of only one hand (or finger) to operate or actuate latch 14 and open cover 12. Latch 14 is operated by being moved between an engaged (e.g., locked, closed, etc.) position (see FIGS. 2, 7, 9, and 12) and a disengaged (e.g., unlocked, open, etc.) position (see FIGS. 1, 8, and 10). According to a preferred embodiment, moving latch 14 between the engaged and disengaged position may be done with one hand, or a single finger of one hand. By providing "one-handed" manipulation of the latch 14, it is intended to allow for the other hand to be free to handle items (i.e., load or unload articles into or from, respectively, storage unit 10).

Before proceeding to the detailed description of the preferred and exemplary embodiment, several comments can be made about the general applicability and the scope thereof.

First, construction and operation of the latch described in this specification may be used with any article (e.g., lid, top, door, hood, panel, etc.) that provides access in addition to the cover specifically illustrated. Additionally, the associated latch and its operation may have any of a variety of applications for other articles that employ a "locking" feature (or otherwise secured when in a "closed" position). Further, the latch may be used with a variety of items that secured when in a "closed" position (e.g., storage enclosure, containers, totes, bins, boxes, lockers, trunks, coolers, etc.). It is also important to note that the term "storage unit," "latch," and "cover" are intended to be broad terms and not a terms of limitation.

Second, the particular materials used to construct the illustrated embodiments are also illustrative. For example, as will be appreciated by those familiar with the art, the storage unit and latch components can be made from any of a variety of plastics or elastomers such as polypropylene, polyethylene, acrylonitrile butadiene styrene ("ABS"), nylon, any of a variety of homopolymer plastics, copolymer plastics, plastics with special additives, filled plastics, wood, plastic, rubber, metal, etc., and a variety of other materials known to those familiar with the art. Also, the components may be manufactured from any of a variety of manufacturing methods (e.g., molding, blow molding, injection molding, stamping, etc.).

Further, the preferred and exemplary embodiments are illustrated with the latch in a generally horizontal position, and located on the front side of the storage unit (see FIGS. 1 and 2). Alternative embodiments may be constructed with any of a variety of latch orientations and positions according to the desired configuration of the storage unit, latch performance, or manufacturing considerations (see for example, FIGS. 1, 4, and 5). Also, the latch may be located on the cover as in the preferred embodiment (see FIG. 1), or on other components of the storage unit (e.g., the base). Furthermore, the latch shown in the illustrated embodiments is generally elliptical or oval in plan view, but can be circular, square, rectangular or any other shape.

Proceeding now to descriptions of the preferred and exemplary embodiments, FIGS. 1 and 2 show storage unit 10 having a base 16 and cover 12 configured to provide access to an interior (storage) space 18 defined by base 16.

Base 16 includes a bottom wall 20 and sidewalls 22 that define storage space 18. A rim 24 projects from side walls 22 and is further connected by a plurality of ribs 26 between rim 24 and sidewalls 22. Ribs 26 are intended to improve manufacturability and to provide rigidity and support for rim 24. According to alternative embodiments, base 16 may have any of a variety of configurations (e.g., curved, arcuate, cylindrical, multi-sided, etc.).

Figure 3:
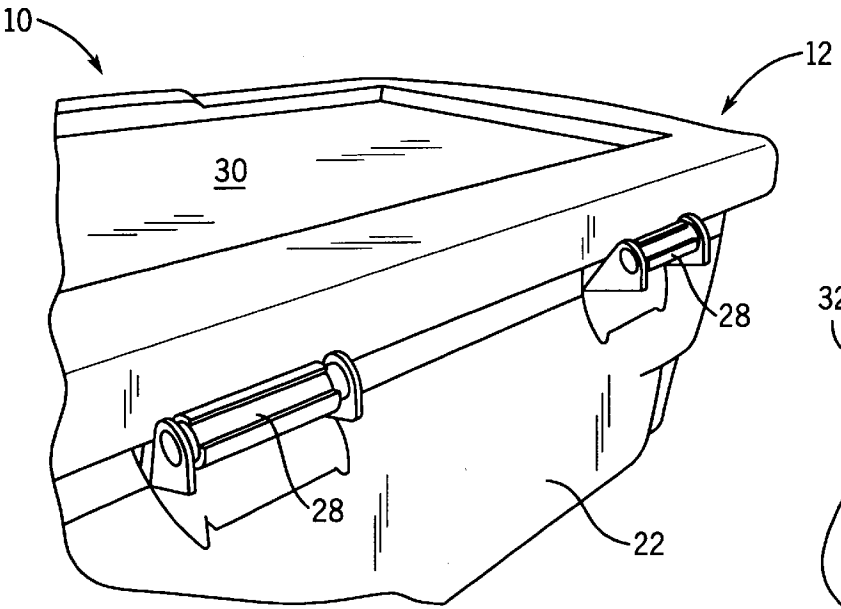
FIG. 3 is a rear perspective view of the storage unit of FIG. 1.

According to a preferred embodiment as shown in FIG. 3, cover 12 is coupled to base 16 by one or more hinges 28 and one or more latches 14. Hinge 28 may be any of a variety of known pivotal coupling mechanisms that couples cover 12 to base 16. According to alternative embodiments, storage unit 10 does not include hinge 28 but is secured in place with a flange (e.g., a hook) that engages rim 24 of base 16 in an interference fit (e.g., the hook grabs rim 24 on one or more sides of base 16). Alternatively, two or more latches 14 may be placed about the cover (e.g., on opposite sides) such that the user may unlock cover by disengaging latches 14 nearly simultaneously.

Cover 12 is configured to be moved between an open position (see FIG. 2) and a closed position (see FIG. 1) to provide access to storage space 18. (Alternatively, cover 12 is configured to be removed entirely from base 16.) Cover 12 includes a top surface 30 a rim 32. According to a preferred embodiment, rim 32 of cover 12 fits (e.g., loosely or snugly) adjacent rim 24 of base 16.

Latch 14 is configured to actuate between an engaged (unlocked, open, etc.) position (see FIGS. 1, 8, and 10) and a disengaged (unlocked, closed, etc.) position (see FIGS. 2, 7, 8, and 12). Latch 14 is further configured to be operated using one hand to releasably engage storage unit 10 so that cover 12 may be moved to provide access to interior space of base 16. According to an exemplary embodiment, latch 14 actuates by pivoting about a pivot axis 34. According to a preferred embodiment, pivot axis 34 is disposed between ends 36, 38 to provide a toggle movement (e.g., rocking or teetering action, or the like).

Figure 4:
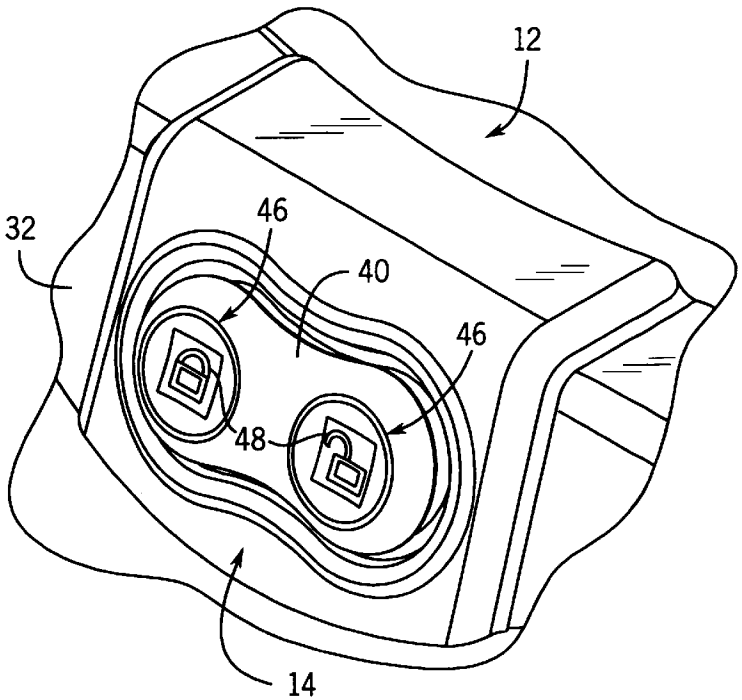
FIG. 4 is a fragmentary perspective view of the storage unit of FIG. 1.
Figure 5:
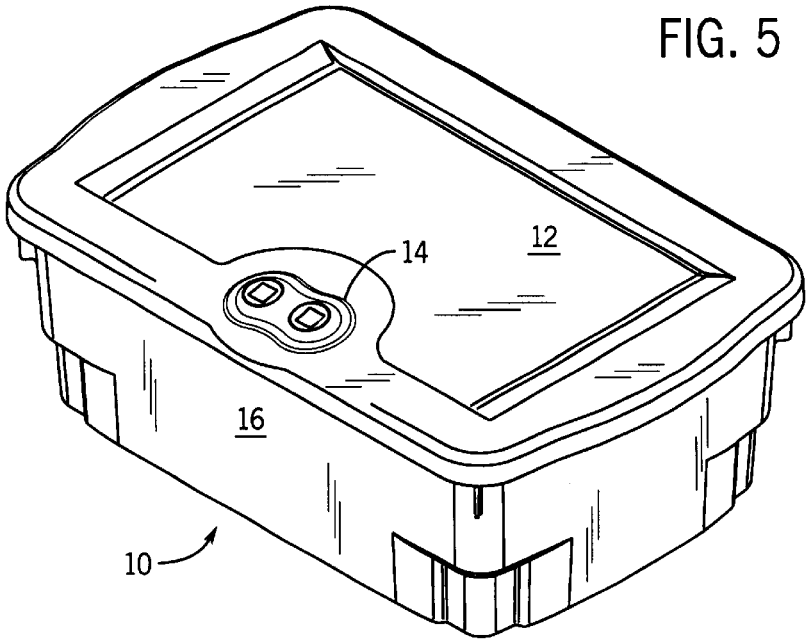
FIG. 5 is a schematic perspective view of a storage unit according to an exemplary embodiment.
Figure 6:
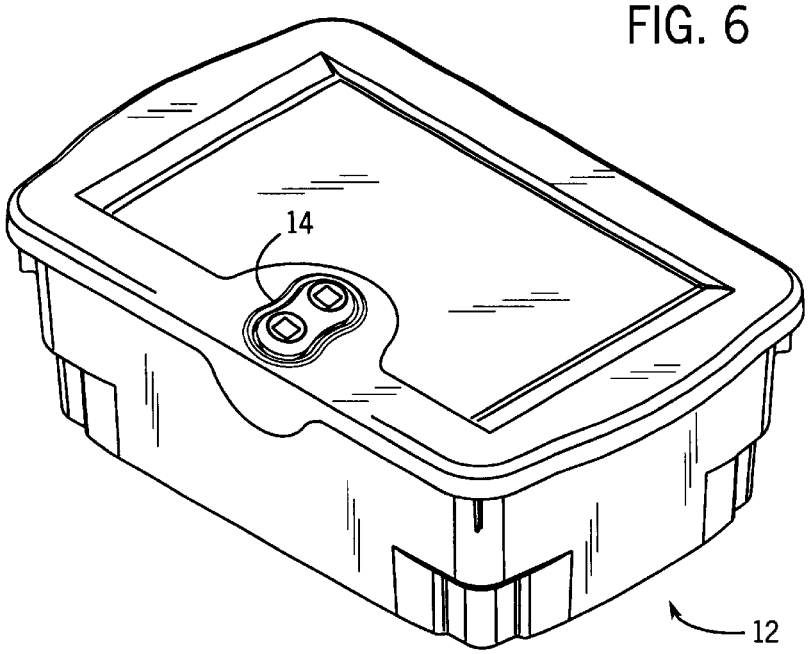
FIG. 6 is a schematic perspective view of a cover for a storage unit according to an exemplary embodiment.
Figure 9:
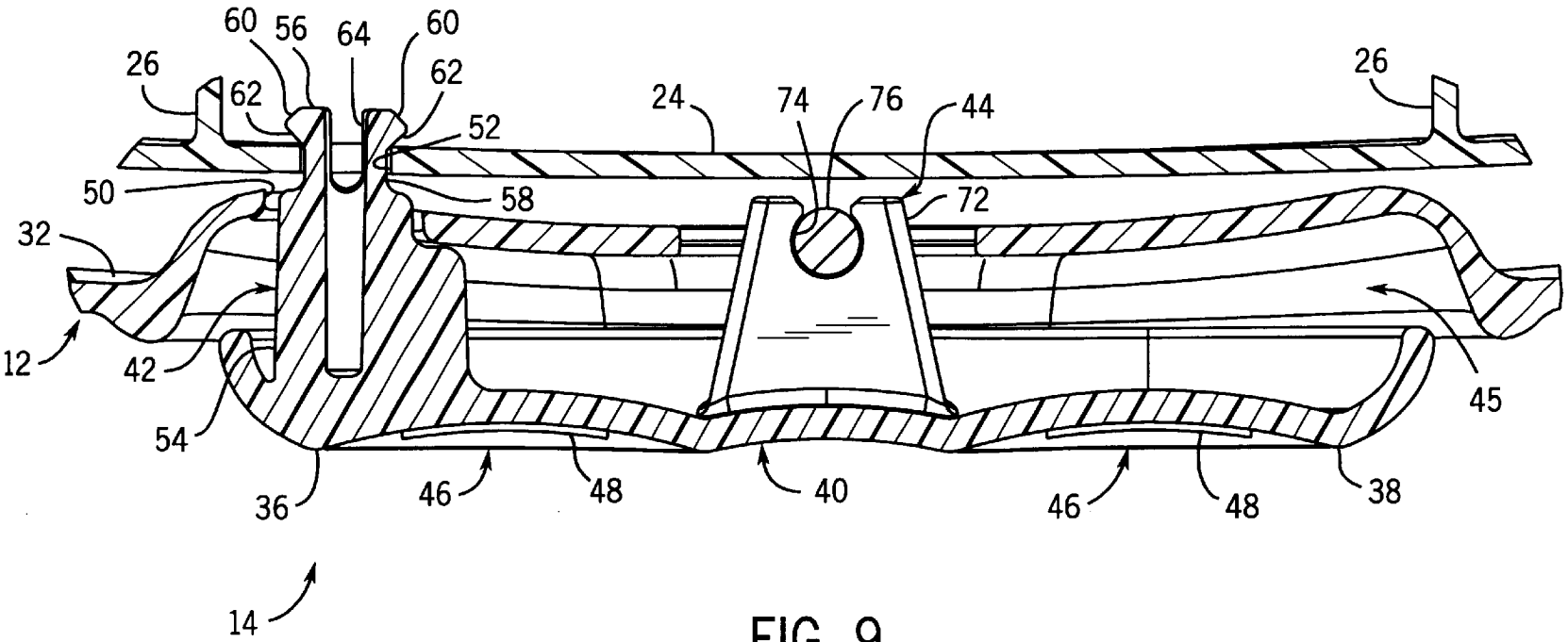
FIG. 9 is a sectional view of storage unit of FIG. 7 taken along the line 9—9.
Figure 10:
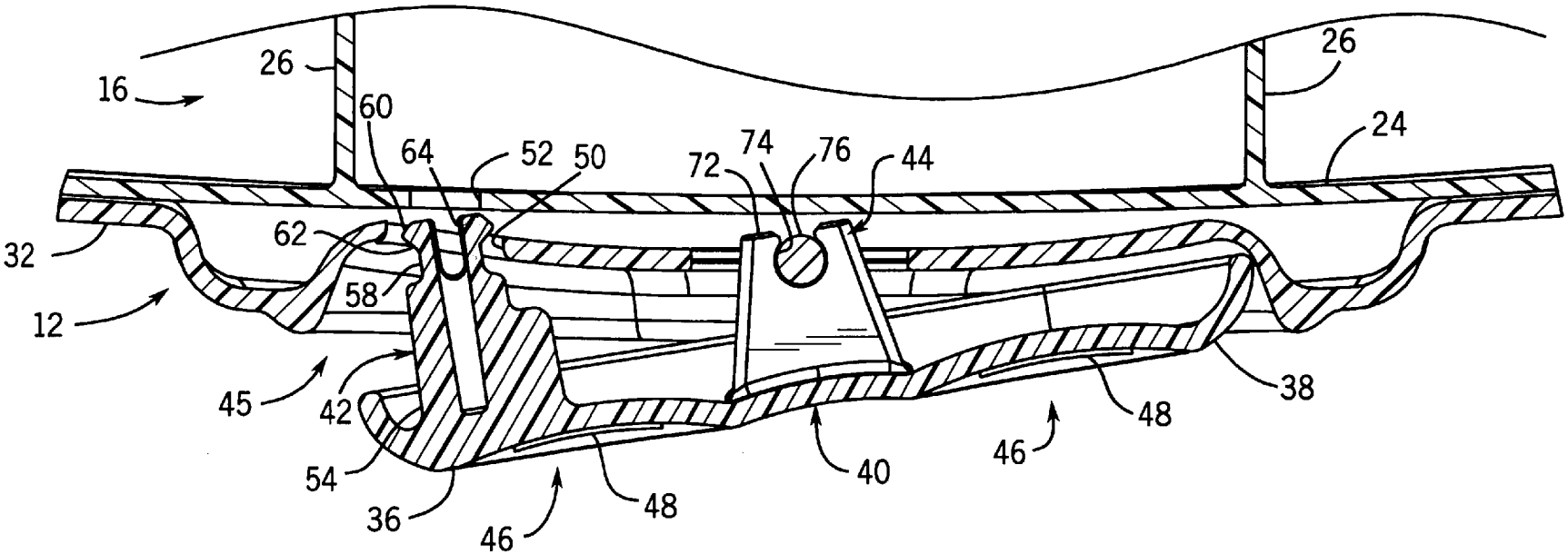
FIG. 10 is a sectional view of storage unit of FIG. 8 taken along the line 10—10.
Figure 11:
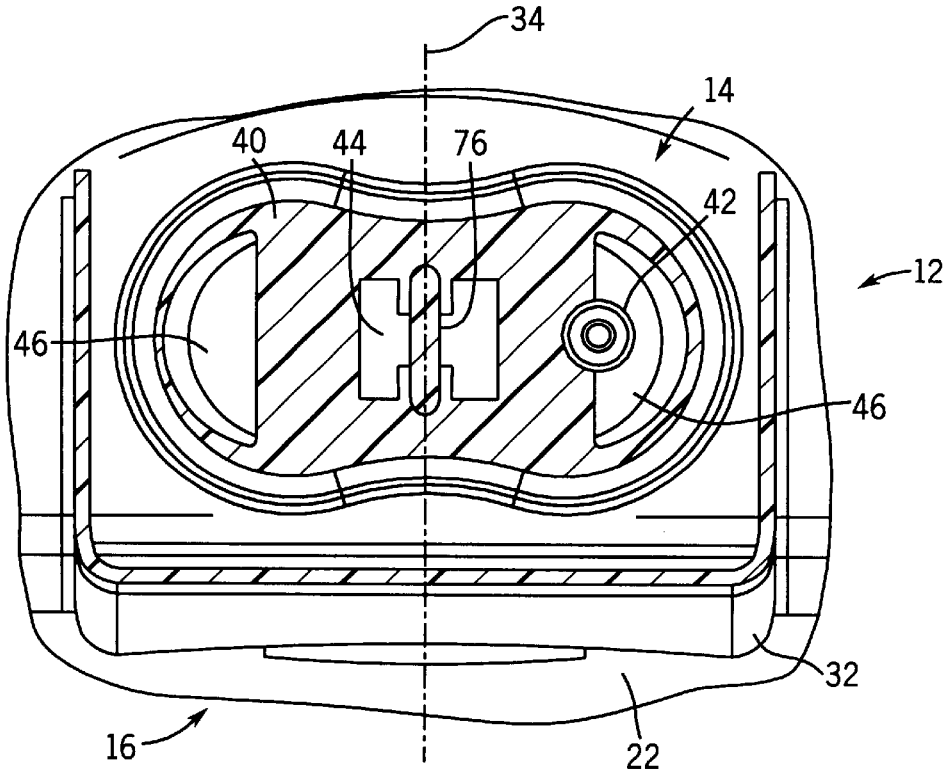
FIG. 11 is a sectional view of storage unit of FIG. 1 taken along the line 11—11.
Figure 12:
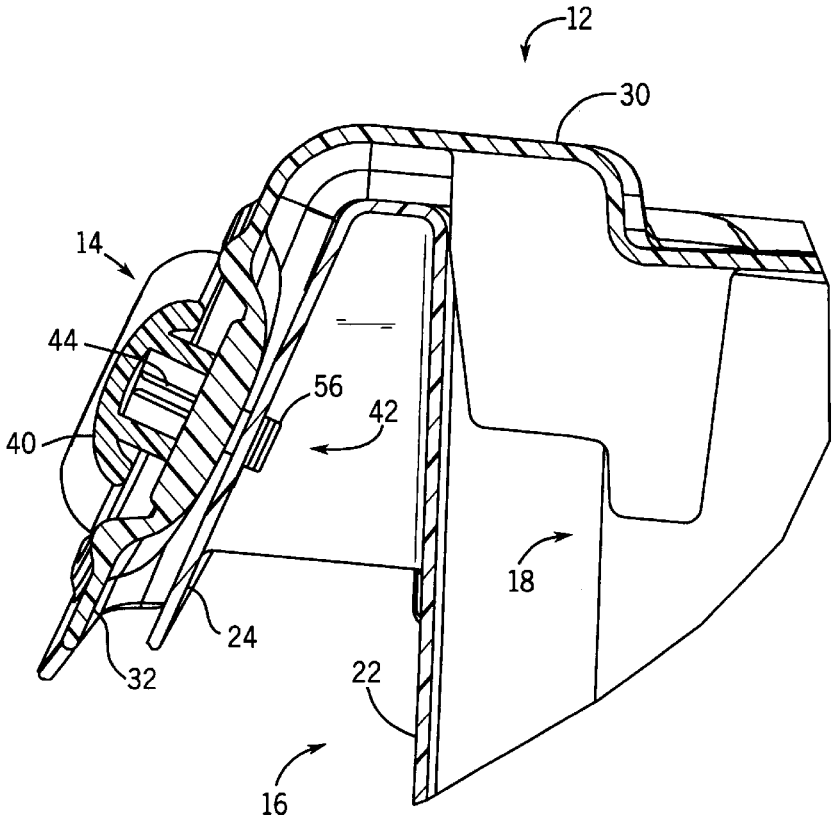
FIG. 12 is a sectional view of storage unit of FIG. 7 taken along the line 12—12.

Referring to FIGS. 4, 9, and 10, latch 14 includes a user interface 40 (e.g., pad, base member, actuator, etc.), a post 42 (e.g., member, boss, button, extension, etc.) extending from base 16, and an attachment member 44 (e.g., clamp, grip, etc.). Latch 14 is in the locked position when post 42 engaged or coupled with base 16.

User interface 40 provides an interface for the user to acutate latch 14 between the locked and unlocked positions. User interface 40 may have any of a variety of shapes and configurations that are adapted to fit in a similarly-shaped and configured area (e.g., recess) in rim 32 of cover 12. User interface 40 includes ends 36, 38 configured to provide push points for the user. Ends 36, 38 may include indexes 46 (e.g., concave surfaces, depressions, dimples, recesses, convex surfaces, bumps, ridges, etc.) configured to receive a finger (e.g., a thumb) of the user. Ends may 36, 38 may also include indicia 48 (painted, inked, raised surface(s), etc.) to inform the user how to actuate latch 14. As shown in FIG. 4, indicia 48 may be an outline of a padlock in a locked position (exemplifying the end to actuate to engage or lock the latch), and in an unlocked position (exemplifying the end to actuate to disengage or unlock the latch).

Referring to FIGS. 9 and 10, post 42 extends through an aperture 50 in rim 32 of cover 12 to releasably engage an aperture 52 in rim 24 of base 16 to lock and unlock latch 14. According to a preferred embodiment, post 42 includes a base 54, a head 56, and a neck 58 intermediate head 56 and base 54. Head 56 is configured (e.g., dimensioned) to be larger than corresponding aperture 52 of base 16, and to deflect or distort when engaging or disengaging rim 52. Head 56 may have any of a variety of shapes and sizes which generally correspond with the shape and size of aperture 52 (e.g., rectangular, circular, ovular, etc.). According to a preferred embodiment, head 56 has a circular cross-section and includes a first ramped surface 60 (e.g., conically-shaped) having its smaller diameter furthest from user interface 40, and a second ramp surface 62 (e.g., conically-shaped) having its smaller diameter nearest user interface 40. When latch 14 is in the engaged/locked position, head 56 is configured to resistively prevent post 42 from being removed from its position (between sidewall 22 and rim 24 of base 16) by dimensional interference with aperture 52 (e.g., the diameter of aperture 52 is less than the largest diameter of head 56).

According to a preferred embodiment, post 42 includes a slot 64 to allow deflection or distortion of head 56, neck 58, and base 54. According to a particularly preferred embodiment, slot 64 extends down approximately one-quarter the height of post 42. A portion of slot 64 may extend approximately the entire height of post 47.

According to a preferred embodiment, post 42 is made from a compliant material (e.g. plastic, elastomer, etc.)

having a "memory" so that when latch 14 engages or disengages base 16, head 56 deflects or distorts and returns to substantially the same shape and configuration after passing through aperture 52 in rim 24 of base 16. Rim 24 of base 16 may also be made out of a compliant material having a memory so that it may also (or alternatively) deflect during engagement or disengagement.

Figure 13:
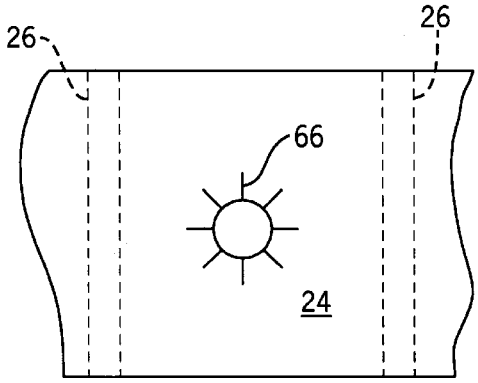
FIG. 13 is a schematic fragmentary elevation view of a storage unit according to an exemplary embodiment.
Figure 14:
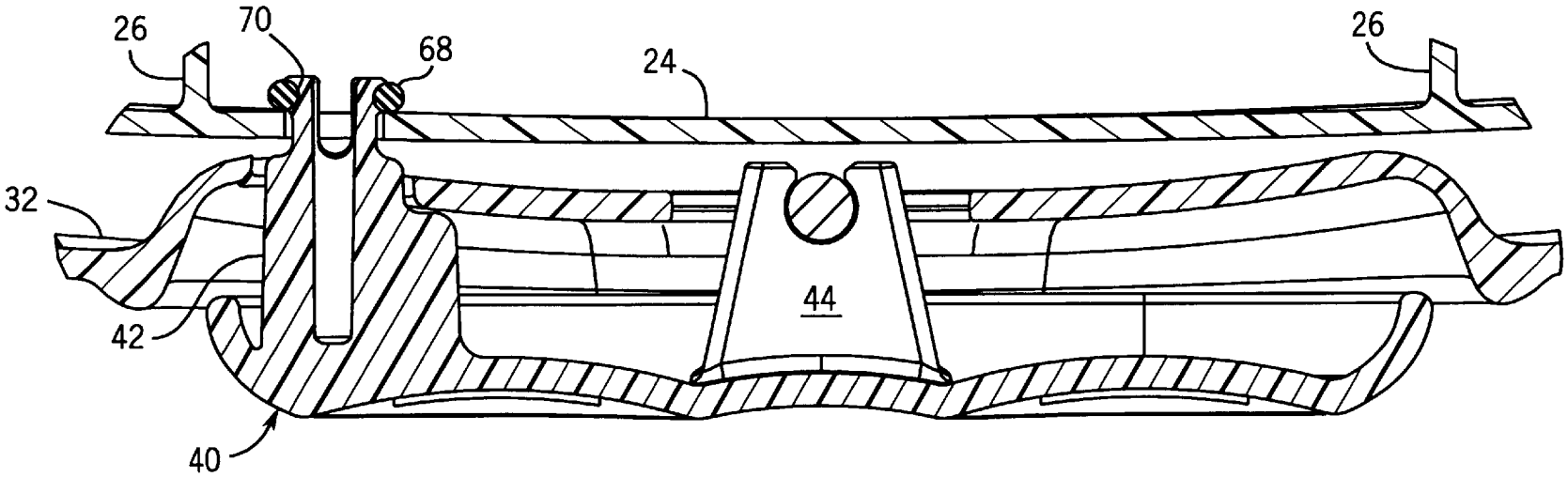
FIG. 14 is a schematic fragmentary elevation view of a storage unit according to an exemplary embodiment.

Latch 14 may have a variety of alternative embodiments that provide for "one-handed" locking and unlocking of storage unit 10. For example, post 42 may be positioned on base 16 and aperture may be disposed on latch 14. Referring to FIG. 13, slots 66 that extend from edge(s) of aperture 52 (e.g., radially, perpendicularly, etc.) may be provided (e.g., in rim 24 of base 16, in comparable rim in latch 14, etc.) so that material around aperture 52 deflects during engagement or disengagement. Referring to FIG. 14, post 42 may include a compressible member 68 (e.g., a grommet, o-ring, etc.) that deflects when post 42 is engaging or disengaging aperture 52. Compressible member 68 may be seated in neck 58, or may be seated in a circumferential groove 70 in post 42. Alternatively, the compressible member may be configured to be disposed in rim 24 of base 16 when in the engaged/locked position and to provide a friction force to resist disengagement or unlocking of latch 14.

Referring again to FIGS. 9 and 10, attachment member 44 couples to cover 12 and provides a fulcrum about which user interface 40 may pivot and leverage against. According to a preferred embodiment, attachment member 44 includes a pair of spaced apart flanges 72 that define a socket 74. Socket 74 is configured to receive (e.g., in a snap-fit connection) a member or axle (shown as a rod 76) on cover 12. According to a preferred embodiment, flanges 72 form a "C-shape" that fits around rod 76 (e.g., more than 180°) in a snap fit engagement. Ends 36, 38 of user interface 40 are spaced from attachment member 44 at a distance to provide leverage for engagement and disengagement of latch 14 from base 16.

It is also important to note that the construction and arrangement of the elements of the latch as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, the location or orientation of the latch, the location of the post and the aperture, size and shape of the user interface, etc. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A storage unit comprising:

a cover movable between a closed position and an open position; and a mechanism configured to releasably couple the cover to the base, the mechanism including a member configured to move between a first position and a second position wherein the member is at least partially disposed in an aperture, the aperture extending through at least one of the cover and the base, and a user interface including first and second ends and adapted to move the member to the first position when the first end is pushed and to move the member to the second position when the second end is pushed wherein the mechanism includes an attachment member that extends from the user interface and is configured to provide a fulcrum about which the user interface pivots.

2. The storage unit of claim 1 wherein the attachment member is located approximately midway between the first and second ends of the user interface.

3. The storage unit of claim 1 wherein the member includes a post.

4. The storage unit of claim 1 wherein the member includes a head.

5. The storage unit of claim 4 wherein the head is configured to be moved through the aperture when the member is moved between the first position and the second position.

6. A storage unit comprising:

a base;

a cover movable between a closed position and an open position;

a mechanism configured to releasably couple the cover to the base, the mechanism including a member configured to move between a first position and a second position wherein the member is at least partially disposed in an aperture, the aperture extending through at least one of the cover and the base,;

wherein the mechanism includes a user interface;

wherein the mechanism includes an attachment member that extends from the user interface and is configured to provide a fulcrum about which the user interface pivots;

wherein the member includes a head;

wherein the head is configured to be moved through the aperture when the member is moved between the first position and the second position; and wherein the head is configured to deform when moved through the aperture.

7. The storage unit of claim 6 wherein the head is dimensionally larger than the aperture.

8. The storage unit of claim 6 wherein the head has a first and a second ramped surface.

9. The storage unit of claim 6 wherein the head is configured to resist removal after having been moved through the aperture.

10. A storage unit comprising:

a base;

a cover movable between a closed position and an open position;

a mechanism configured to releasably couple the cover to the base, the mechanism including a member configured to move between a first position and a second position wherein the member is at least partially disposed in an aperture;

wherein the mechanism includes a user interface;

wherein the mechanism includes an attachment member that extends from the user interface and is configured to provide a fulcrum about which the user interface pivots;

wherein the member includes a head;

wherein the head is configured to be moved through the aperture when the member is moved between the first position and the second position; and wherein the head is configured to deform when moved through the aperture wherein the member includes a slot configured to provide relief for the head when it deforms.

11. The storage unit of claim 10 wherein the head is configured to return to an undeformed orientation when the mechanism is engaged.

12. A storage unit comprising:

a base;

a cover movable between a closed position and an open position;

a mechanism configured to releasably couple the cover to the base, the mechanism including a member configured to move between a first position and a second position wherein the member is at least partially disposed in an aperture;

wherein the base includes a first rim;

wherein the cover includes a second rim configured to be disposed adjacent the first rim of the base when the cover is in the first position;

wherein the aperture is located on the first rim; and wherein the base includes a sidewall and one or more ribs between the first rim and the sidewall.

13. The storage unit of claim 12 wherein a pair of ribs are disposed on either side of the aperture and configured to support the first rim when the mechanism is being actuated.

14. A storage unit comprising:

base;

cover movable between a closed position and an open position;

mechanism configured to releasable couple the cover to the base, the mechanism including a member configured to move between a first position and a second position wherein the member is at least partially disposed in an aperture;

wherein the mechanism includes a user interface;

wherein the mechanism includes an attachment member that extends from the user interface and is configured to provide a fulcrum about which the user interface pivots; and wherein the attachment member includes a pair of flanges configured to engage an axle.

15. A storage unit comprising:

a base a cover movable between a closed position and an open position; and a mechanism configured to releasably couple the cover to the base, the mechanism including a member configured to move between a first position and a second position wherein the member is at least partially disposed in an aperture, the aperture extending through at least one of the cover and the base, and a user interface including first and second ends and adapted to move the member to the first position when the first end is pushed and to move the member to the second position when the second end is pushed wherein the mechanism is a toggle.

16. A storage unit comprising:

a base having a rim;

a cover movable between a closed position and an open position; and a mechanism configured to releasably couple the cover to the base, the mechanism including a user interface including first and second ends configured to pivot between a first position when the first end is pressed and a second position when the second end is pressed and a post wherein the post is at least partially disposed in an aperture extending through the rim when user interface is in the second position.

17. The storage unit of claim 16 wherein the mechanism is adapted to be operated quickly and easily by one hand of a user.

18. The storage unit of claim 16 wherein the mechanism includes an attachment member that extends from the user interface and is configured to provide a fulcrum about which the user interface pivots.

19. The storage unit of claim 16 wherein the post includes a head configured to be moved through the aperture when the user interface is moved between the first position and the second position.

20. A storage unit comprising:

a base having a rim;

a cover movable between a closed position and an open position; and a mechanism configured to releasably couple the cover to the base, the mechanism including a user interface configured to pivot between a first position and a second position and a post wherein the post is at least partially disposed in an aperture extending through the rim when the user interface is in the second position;

wherein the post includes a head configured to be moved through the aperture when the user interface is moved between the first position and the second position; and wherein the head is configured to deform when moved through the aperture.

21. The storage unit of claim 20 wherein the head is dimensionally larger than the aperture.

22. The storage unit of claim 20 wherein the head has a first and second ramped surface.

23. A storage unit comprising:

a base having a rim;

a cover movable between a closed position and an open position; and a mechanism configured to releasably couple the cover to the base, the mechanism including a user interface configured to pivot between a first position and a second position and a post wherein the post is at least partially disposed in an aperture in the rim when the user interface is in the second position;

wherein the post includes a head configured to be moved through the aperture when the user interface is moved between the first position and the second position; and wherein the head is configured to deform when moved through the aperture;

wherein the post includes a slot configured to provide relief for the head when it deforms.

24. A storage unit comprising:

a base having a rim;

a cover movable between a closed position and an open position; and a latch configured to releasably couple the cover to the base, the latch including:

a user interface having first and second ends and configured to pivot between a first position when the first end is pushed and a second position when the second end is pushed;

a post configured to be at least partially disposed in an aperture extending through the rim when the user interface is in the second position; and an attachment member that extends from the user interface and is configured to provide a fulcrum about which the user interface pivots.

25. The storage unit of claim 24 wherein the latch is adapted to be operated quickly and easily by one hand of a user.

26. The storage unit of claim 24 wherein the post includes a head configured to be moved through the aperture when the user interface is moved between the first position and the second position.

27. A storage unit comprising:

a base having a rim;

a cover movable between a closed position and an open position; and a latch configured to releasably couple the cover to the base, the latch including:

a user interface configured to pivot between a first position and a second position;

a post configured to be at least partially disposed in an aperture extending through the rim when the user interface is in the second position; and an attachment member that extends from the user interface and is configured to provide a fulcrum about which the user interface pivots;

wherein the post includes a head configured to be moved through the aperture when the user interface is moved between the first position and the second position; and wherein the head is configured to deform when moved through the aperture.

28. A storage unit comprising:

a base having a rim;

a cover movable between a closed position and an open position; and a latch configured to releasably couple the cover to the base, the latch including:

a user interface configured to pivot between a first position and a second position;

a post configured to be at least partially disposed in an aperture in the rim when the user interface is in the second position; and an attachment member that extends from the user interface and is configured to provide a fulcrum about which the user interface pivots;

wherein the post includes a head configured to be moved through the aperture when the user interface is moved between the first position and the second position; and wherein the head is configured to deform when moved through the aperture;

wherein the post includes a slot configured to provide relief for the head when it deforms.

* * * * *

UNITED STATES PATENT AND TRADEMARK OFFICE

CERTIFICATE OF CORRECTION

PATENT NO. : 6,779,681 B2
DATED : August 24, 2004
INVENTOR(S) : Doerfler et al.

It is certified that error appears in the above-identified patent and that said Letters Patent is hereby corrected as shown below:

Column 6,
Line 2, please change "1. A storage unit comprising: a cover movable …" to
-- 1. A storage unit comprising:
a base;
a cover movable.. --.

Signed and Sealed this

Third Day of May, 2005

JON W. DUDAS
*Director of the United States Patent and Trademark Office*